US007649501B2

(12) United States Patent
Wong et al.

(10) Patent No.: US 7,649,501 B2
(45) Date of Patent: Jan. 19, 2010

(54) ULTRA-WIDEBAND ANTENNA STRUCTURE

(75) Inventors: Kin-Lu Wong, Kaohsiung (TW); Jui-Hung Chou, Taichung (TW); Saou-Wen Su, Taipei (TW)

(73) Assignees: Lite-On Technology Corp., Taipei (TW); National Sun Yat-Sen University, Kaohsiung (TW)

( * ) Notice: Subject to any disclaimer, the term of this patent is extended or adjusted under 35 U.S.C. 154(b) by 241 days.

(21) Appl. No.: 11/675,588

(22) Filed: Feb. 15, 2007

(65) Prior Publication Data

US 2007/0273604 A1 Nov. 29, 2007

(30) Foreign Application Priority Data

May 29, 2006 (TW) ..... 95119076 A

(51) Int. Cl.
*H01Q 1/24* (2006.01)

(52) U.S. Cl. ..... 343/702

(58) Field of Classification Search ..... 343/846, 343/702, 700 MS
See application file for complete search history.

(56) References Cited

U.S. PATENT DOCUMENTS

| | | | | |
|---|---|---|---|---|
| 6,917,334 | B2 * | 7/2005 | Chen | 343/700 MS |
| 7,253,772 | B2 * | 8/2007 | Chi et al. | 343/700 MS |
| 2005/0030230 | A1 * | 2/2005 | Otaka et al. | 343/700 MS |

* cited by examiner

*Primary Examiner*—Hoang V Nguyen
*Assistant Examiner*—Robert Karacsony

(57) ABSTRACT

An ultra-wideband antenna structure is provided. The ultra-wideband antenna structure includes a substrate with an edge, a first surface and a second surface opposite to the first surface; a ground surface mounted on the first surface; a radiating element mounted on the second surface and near the edge, and being a bent metal piece; and a short-circuited metal unit mounted on the first surface having a first end and a second end, wherein the first end is electrically connected to the ground surface and the second end is electrically connected to the radiating element.

12 Claims, 10 Drawing Sheets

ULTRA-WIDEBAND ANTENNA STRUCTURE

FIELD OF THE INVENTION

The present invention relates to an ultra-wideband antenna structure, and more particularly to an ultra-wideband antenna structure that can be applied in a plug-and-play device.

BACKGROUND OF THE INVENTION

Recently, the wireless communication industry has been rising and flourishing, and different kinds of products and techniques have been provided, which are all emphasized on miniaturizing the product size for fashion and easy-taking. Miniaturization has been the major trend for the wireless communication industry.

All wireless communication devices transmit signals by antennas, and the ultra-wideband antenna is especially popular because the frequency bands use thereof will be more flexible. Although the ultra-wideband antenna is popular in industrial and academic circles, the conventional size thereof is relatively large for being embedded inside the plug-and-play device so that the application thereof is limited.

The prior arts such as US2004/0100408A1, "Wide Bandwidth antenna", and US2005/0062670A1, "Planar wideband Antenna", both disclose such ultra-wideband antennas, wherein the bandwidth thereof ranges from 3.1 to 10.6 GHz, and the definition of bandwidth is with the return loss better than 10 dB.

From the above description, it is known that how to develop an ultra-wideband antenna miniaturized and suitable to be embedded inside a plug-and-play device has become a major problem to be solved. In order to overcome the drawbacks in the prior art, a novel ultra-wideband antenna is provided. The particular design in the present invention not only solves the problems described above, but also is easy to implement. Thus, the present invention has the utility for the industry.

SUMMARY OF THE INVENTION

In accordance with the present invention, there is provided an ultra-wideband antenna structure that comprises a substrate, a ground surface, a radiating element, and a short-circuited metal unit. The substrate has an edge, a first surface and a second surface opposite to the first surface, and the ground surface is mounted on the first surface, while the radiating element which is a bent metal piece is mounted on the second surface and near the edge. As to the short-circuited metal unit that is mounted on the first surface, it has a first end and a second end, and the first end is electrically connected to the ground surface while the second end is electrically connected to the radiating element.

Preferably, the radiating element further comprises a front end, a distal end, at least two bending lines, a radiating portion having an opening direction, a feeding point, and a short-circuiting point. Furthermore, the feeding point is disposed near the front end and receives a signal transmitted to the antenna, and the short-circuiting point is disposed near the distal end and connected to the short-circuited metal unit. In addition, the bent metal piece is approximately U-Shaped, and the front end, the distal end and the at least two bending lines are all approximately perpendicular to the opening direction with the opening direction approximately paralleling the substrate.

Preferably, the radiating element further comprises two arms partitioned by the radiating portion, and each of the two arms has an identical width.

Preferably, the radiating element further comprises two arms partitioned by the radiating portion, and each of the two arms has an increasing width from the front end to the distal end.

Preferably, the radiating element further comprises two arms partitioned by the radiating portion, and each of the two arms has a decreasing width from the front end to the distal end.

Preferably, the substrate is rectangular.

Preferably, the ultra-wideband antenna structure further comprises a supporting unit mounted between the radiating element and the substrate for supporting thereby the radiating element.

Preferably, the supporting unit is made of a polystyrene or a plastic.

Preferably, the bent metal piece is made by bending a metal piece being processed with one of a stamping and a cutting.

Preferably, the ground surface and the short-circuited metal unit are mounted on the substrate by one of a printing and an etching.

Preferably, the substrate is made of a dielectric material.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1A:
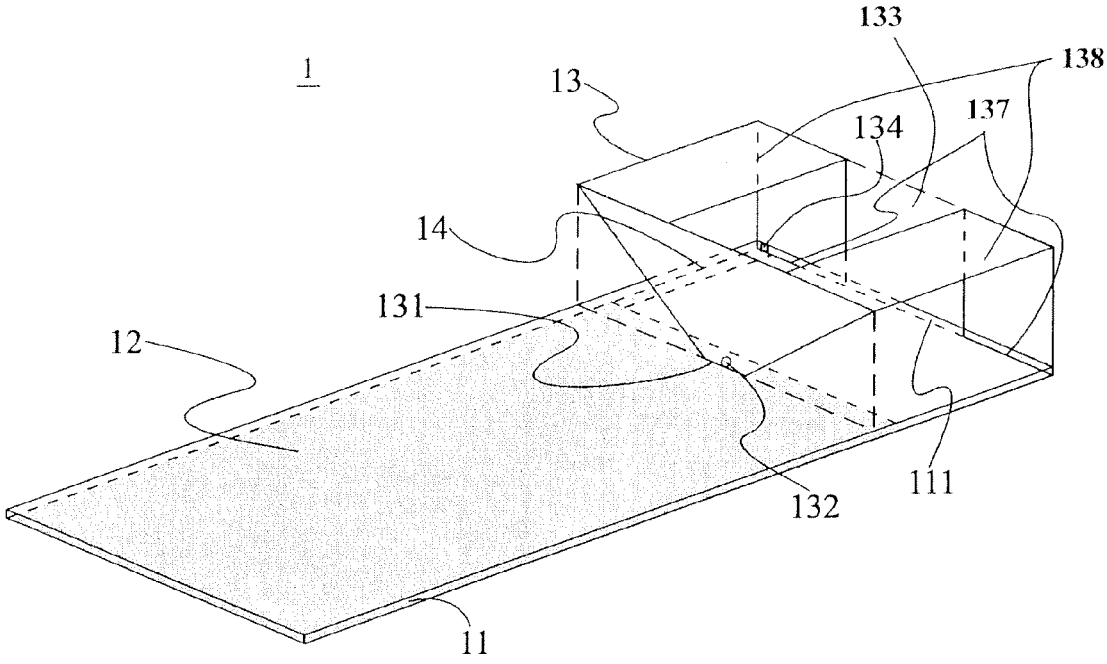
FIG. 1(A) is a three-dimensional diagram of an ultra-wideband antenna structure according to a first preferred embodiment of the present invention.
Figure 1B:
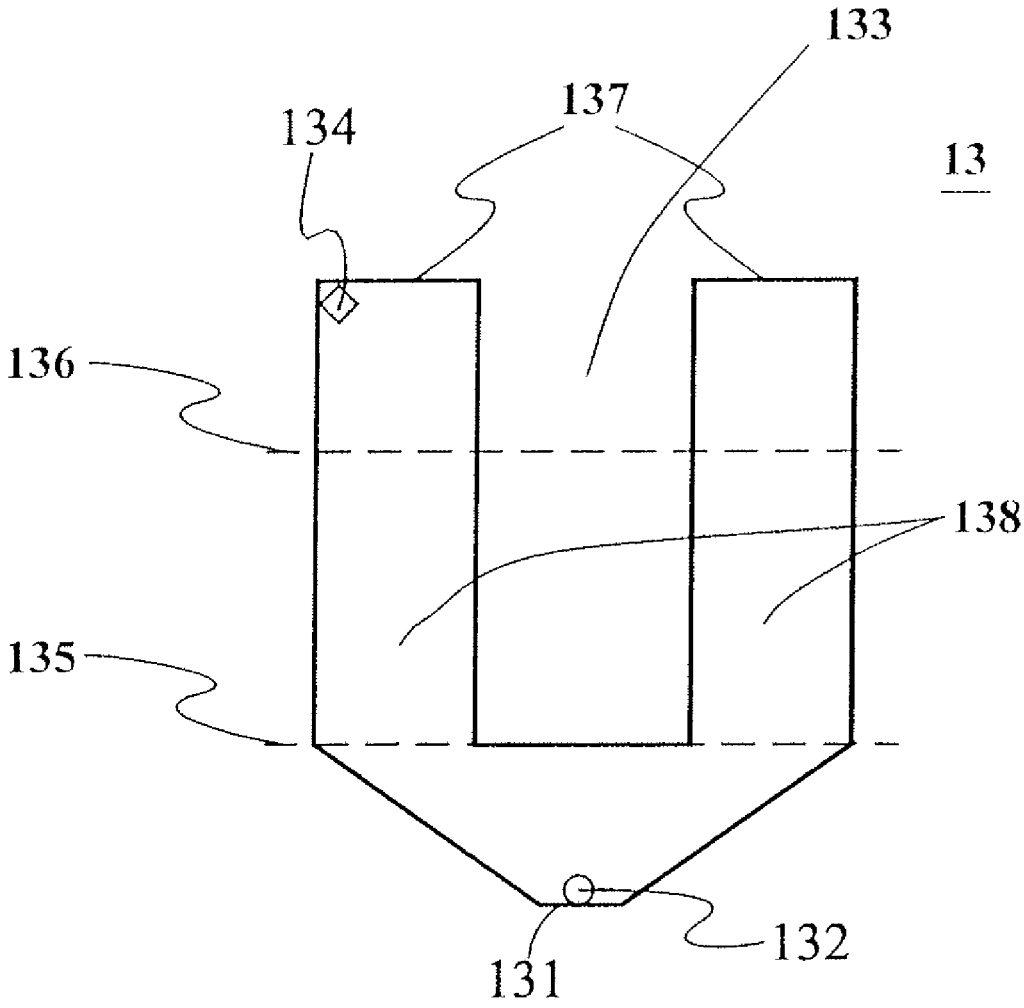
FIG. 1(B) is an expanded diagram of a radiating element (U-shaped metal piece) of the ultra-wideband antenna shown in FIG. 1(A)

Please refer to FIGS. 1(A) and 1(B), wherein FIG. 1(A) shows a three-dimensional diagram of an ultra-wideband antenna structure according to a first preferred embodiment of the present invention, and FIG. 1(B) is an expanded diagram showing a radiating element of the ultra-wideband antenna shown in FIG. 1(A). The ultra-wideband antenna structure 1 in the present invention comprises a substrate 11, a ground surface 12, a radiating element 13, a feeding point 132, a short-circuiting point 134, and a short-circuited metal unit 14. The substrate 11 is made of a dielectric material, with at least one edge 111, and is approximately rectangular as the ground surface 12 thereon. The radiating element 13 is disposed on the substrate 11 and near the edge 111, and is formed by an approximately U-shaped metal piece with at least two bending lines named hereinafter the first bending line 135 and the second bending line 136 respectively. The U-shaped metal piece has a front end 131, a distal end 137, a radiating portion 133 with an open direction approximately parallel to the substrate 11, and two arms 138 partitioned by the radiating portion 133, wherein the two bending lines 135 and 136 are perpendicular to the opening direction and approximately parallel to the front end 131 and the distal end 137. In a preferred embodiment, the front end 131 and the distal end 137 contact the substrate 11, and the feeding point 132 near the front end 131 receives signals. The short-circuiting point 134 is near the radiating portion 133, and the short-circuited metal unit 14 on the substrate 11 has a first and a second ends, wherein the first end is electrically connected to the ground surface 12 and the second end is electrically connected to the short-circuiting point 134.

Figure 2:
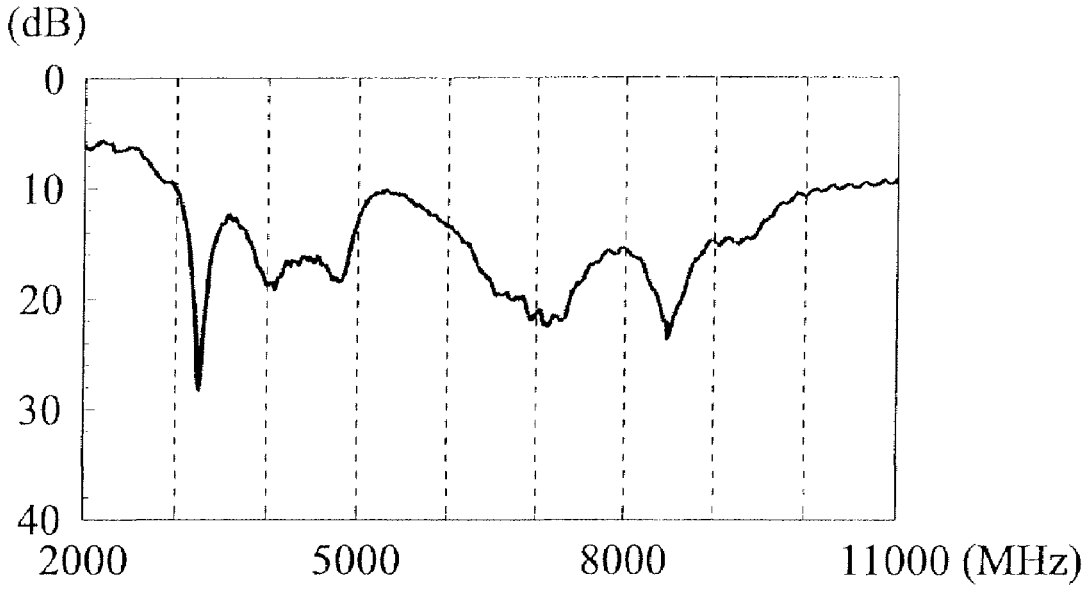
FIG. 2 is a diagram showing the results of return loss measurement according to the first preferred embodiment in FIG. 1(A)

Please refer to FIG. 2, which shows the results of return loss measurement according to the first preferred embodiment in FIG. 1(A). The size of the antenna is as follows: the length of the ground surface 11 is about 60 mm, and the width thereof is about 20 mm; the width of the front end 131 is about 3 mm; the height from the front end 131 to the first bending line 135 is about 6 mm; the width of the radiating portion 133 is about 20 mm; the distance between the first and the second bending lines 135, 136 is about 11 mm, and the widths thereof are about 6 mm; the height from the distal end 137 to the second bending line 133 is about 6.4 mm; the length of the short-circuited metal unit 14 is about 6 mm, and the width thereof is about 1 mm. In FIG. 2, the y-axis represents the return loss and the x-axis represents the operating frequency. As shown in FIG. 2, under the definition of 10-dB return loss, the operating bands of the antenna is from 3.1 to 10.6 GHz, which is thus named the ultra-wideband antenna.

Figure 3:
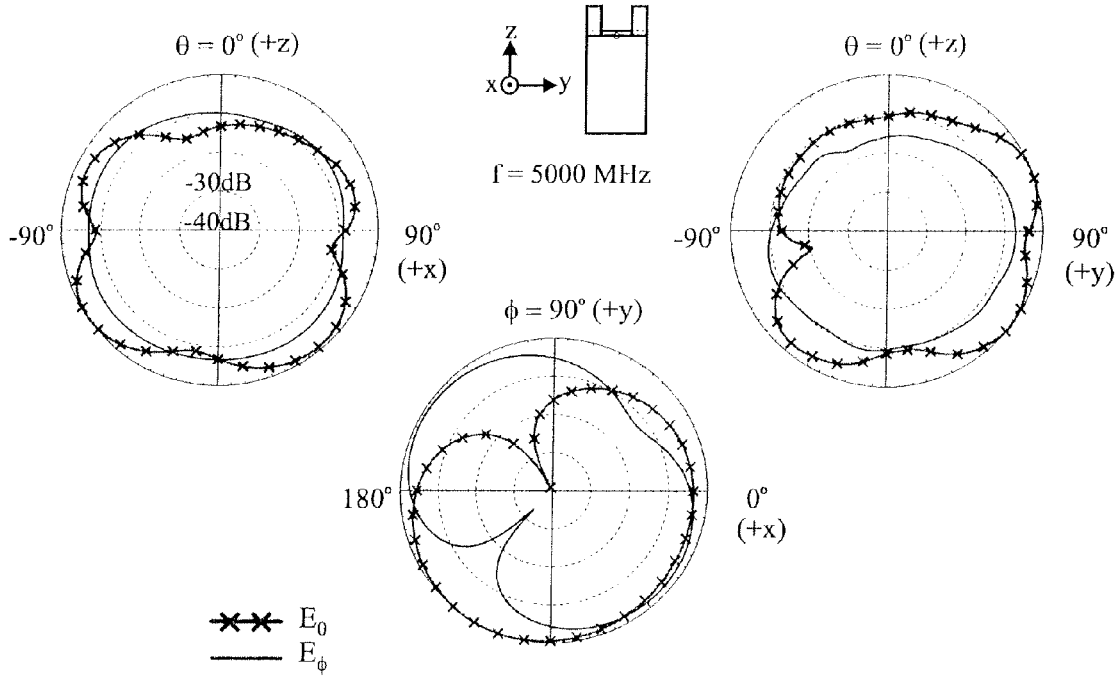
FIG. 3 is a polar graph showing an elevation pattern of the first preferred embodiment in FIG. 1(A) at 5000 MHz.
Figure 4:
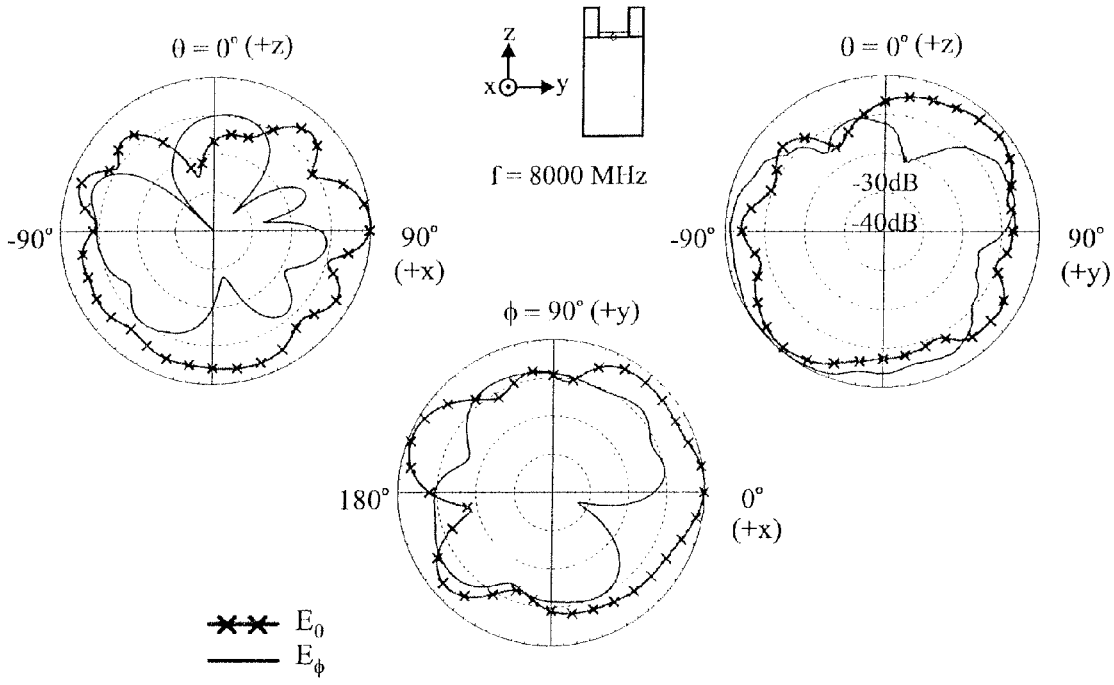
FIG. 4 is a polar graph showing an elevation pattern of the first preferred embodiment in FIG. 1(A) at 8000 MHz.

FIGS. 3-4 are polar graphs showing elevation patterns of the first preferred embodiment respectively at 5000 and 8000 MHz, wherein the top view of the antenna structure is presented therein, which defines the direction of the structure in a three-dimensional space. As shown in FIGS. 3-4, the strengths of electric field components $E_\Theta$ and $E_\Phi$ in the x-y, y-z, and x-z planes are comparable, which improves the radiation efficiency of the ultra-wideband in the complex wave-propagation environment such as indoor wireless communication.

Figure 5:
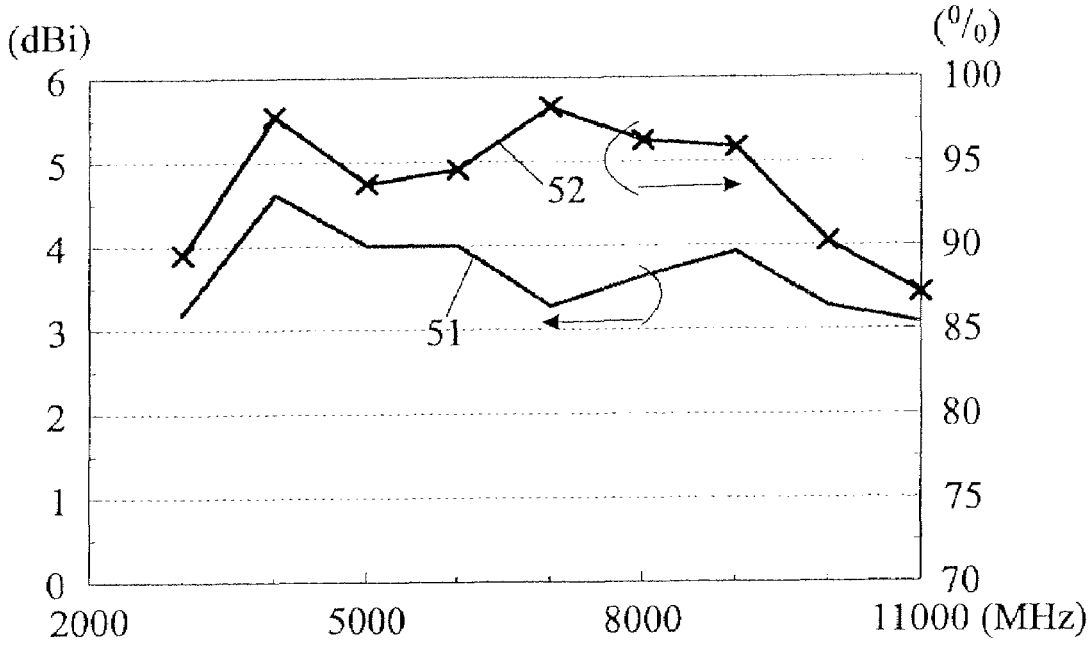
FIG. 5 is a diagram showing the results of antenna gain measurement and radiation efficiency simulation according to the first preferred embodiment in FIG. 1(A)

FIG. 5 is a diagram showing the results of antenna gain measurement 51 and radiation efficiency simulation 52 in the operating bands according to the first preferred embodiment, wherein the left and right y-axes respectively represent the antenna gain (dBi) and the radiation efficiency (%), and the x-axis represents the operating frequency (MHz). As shown in FIG. 5, the antenna gain within the operating bands is about 4.5 dBi, and the corresponding radiation efficiency is approximately higher than 85%, which is acceptable for ultra-wideband operation.

Figure 6A:
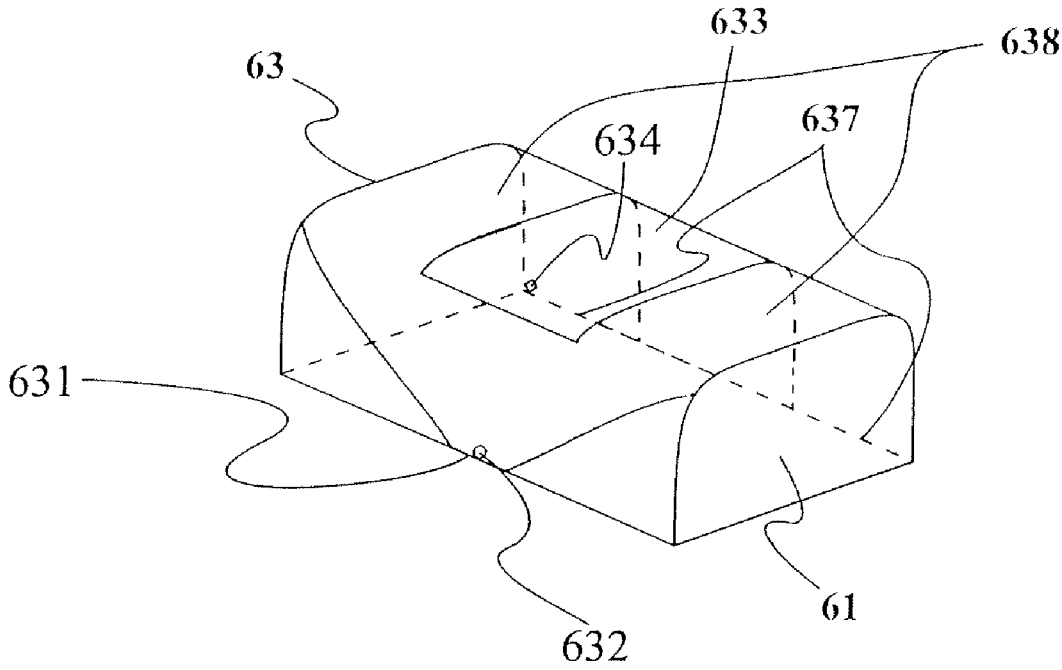
FIGS. 6(A)-6(B) are diagrams showing the structures of the radiating element of the ultra-wideband antenna according to a second and a third preferred embodiments of the present invention.
Figure 6B:
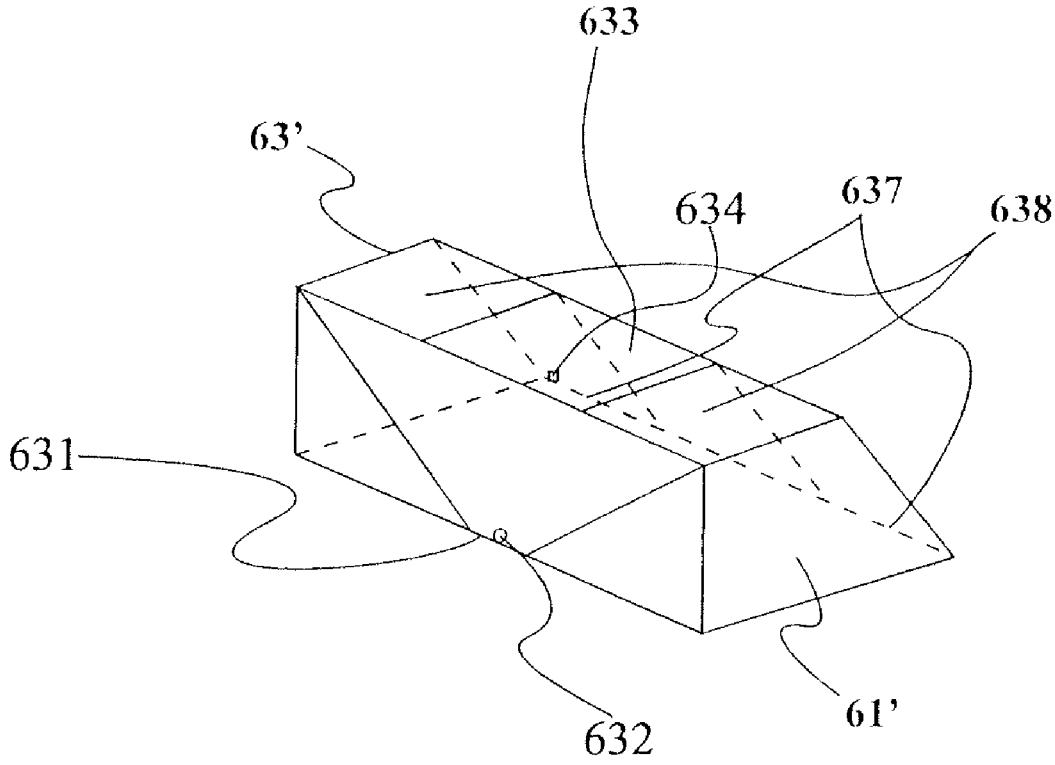

FIGS. 6(A)-6(B) are diagrams showing the structures of the radiating element of the ultra-wideband antenna according to a second and a third preferred embodiments of the present invention, wherein the supporting unit 61 is mounted between the radiating element 63 and the substrate of FIG. 1A, and the supporting unit 61' is mounted between the radiating element 63' and the substrate of FIG. 1A. The supporting units 61, 61' for supporting thereby the radiating elements 63, 63' can be made by the polystyrene or plastic, which are rectangular or trapezoid. In addition, there are a front end 631 and a distal end 637 in the two radiating elements 63 and 63' respectively. The respective operating characteristics of the antennas with the two radiating elements 63 and 63' are similar to that of FIG. 1.

Figure 7A:
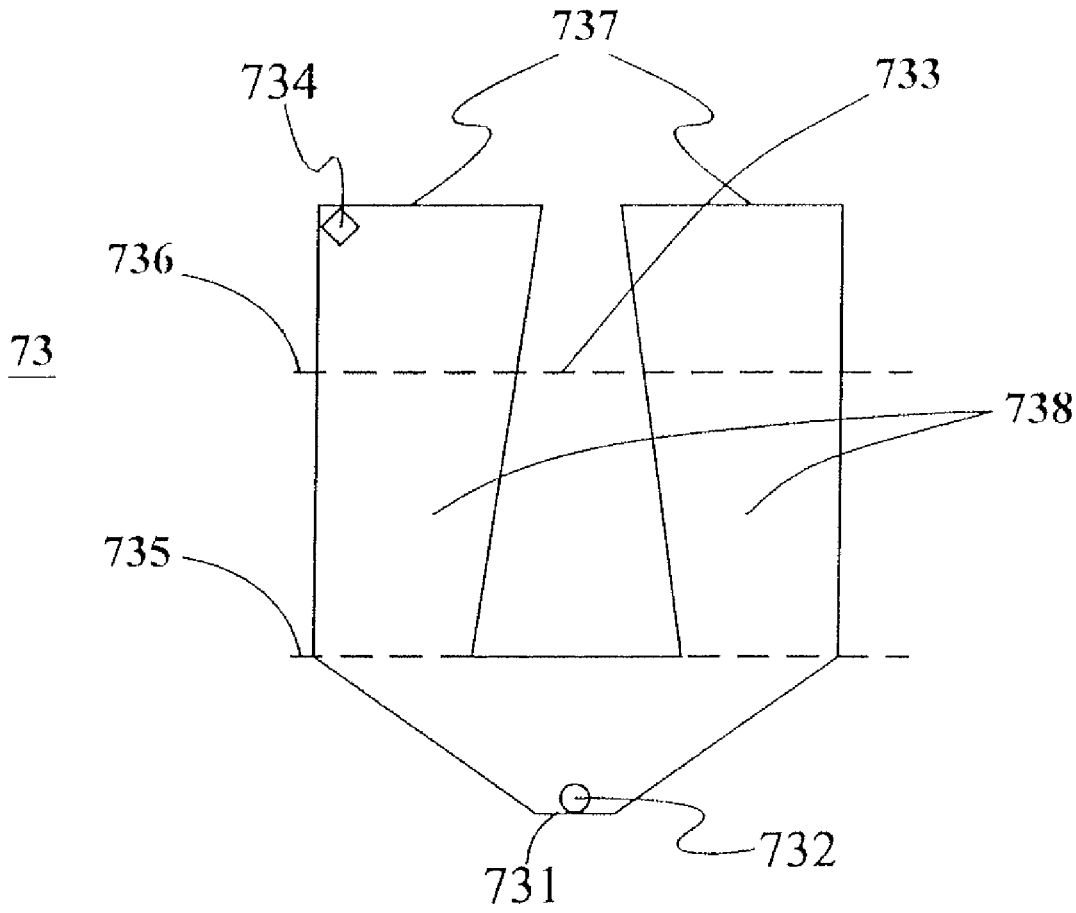
FIGS. 7(A)-7(B) are expanded diagrams showing the structures of the radiating element of the ultra-wideband antenna according to a fourth and a fifth preferred embodiments of the present invention.
Figure 7B:
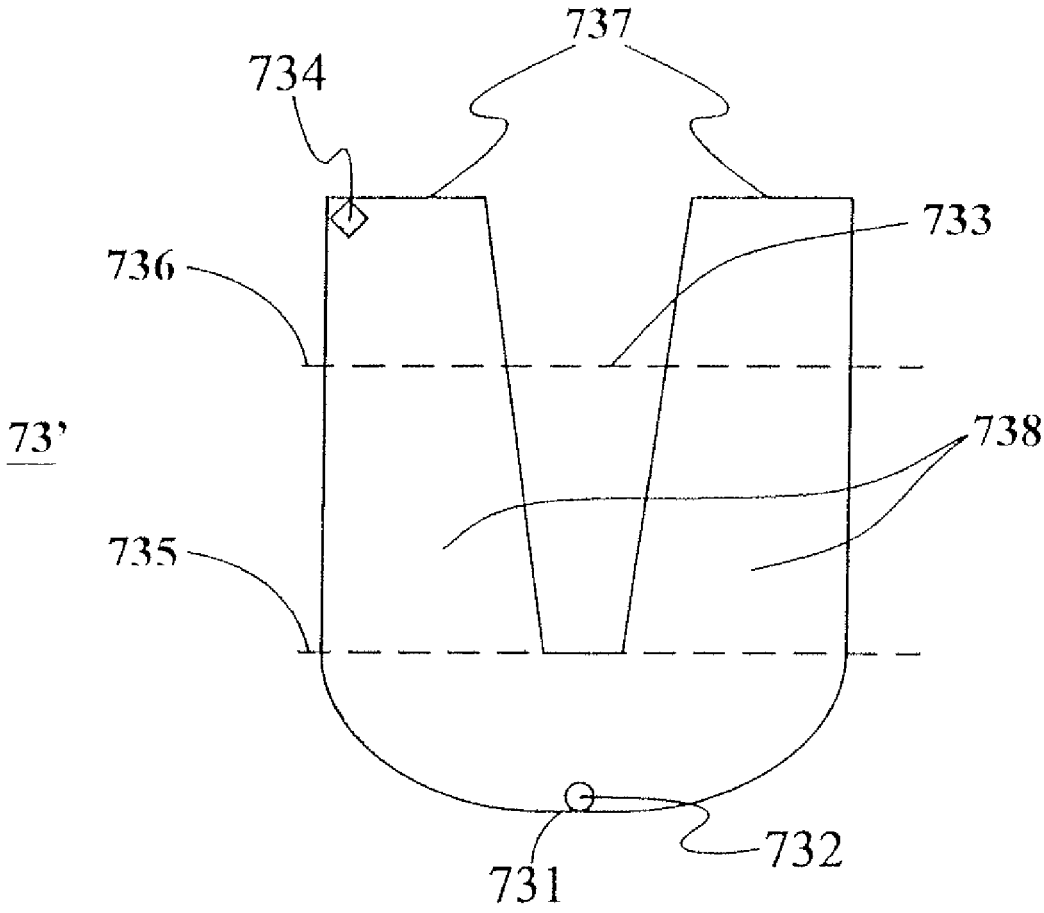

FIGS. 7(A)-7(B) are expanded diagrams showing the structures of the radiating element of the ultra-wideband antenna according to a fourth and a fifth preferred embodiments of the present invention, wherein the radiating element is a U-shaped metal piece. As shown in FIGS. 7(A)-7(B), the U-shaped metal pieces 73, 73' both have two bending lines 735, 736 that are approximately perpendicular to the opening direction of the radiating portions 733 thereof. The respective two arms 738 of the U-shaped metal pieces 73, 73' are getting wider or narrower. In addition, the U-shaped metal pieces 73, 73' respectively have a front end 731 and a distal end 737, wherein the front end 731 can be an arc or a straight line. When using the antennas with the respective U-shaped metal pieces 73 and 73', the operating characteristics thereof are similar to that of FIG. 1.

With regard to the forming process of the above-mentioned ultra-wideband antenna structures, the U-shaped metal piece is made by stamping or cutting a single metal piece, and the ground surface and the short-circuited metal unit are formed on the substrate by printing or etching.

In the present invention, the U-shaped metal piece prevents the antenna structure from exciting the surface loop current, which dramatically improves the impedance matching of the antenna structure, especially within the middle portion (about 5-8 GHz) of the ultra-wideband. Therefore, the antenna structure can be operated in the ultra-wideband, so it is named the ultra-wideband antenna. Besides, the bent U-shaped metal piece can efficiently reduce the antenna size, and the lowest frequency of the ultra-wideband can be efficiency decreased by using the short-circuited metal unit, so the antenna size can be further miniaturized. Importantly, because the antenna and the ground surface are incorporated together, the elements thereof are stable and not easily damaged. All of these features are beneficial for the ultra-wideband antenna to be set inside a plug-and-play device.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An ultra-wideband antenna structure, comprising:

a substrate having an edge, a first surface and a second surface opposite to the first surface;

a ground surface mounted on the first surface;

a radiating element mounted on the second surface and near the edge, being a three-dimensional metal piece, and including:

a front end;

a distal end extending from the front end;

a radiating portion having an opening direction between the front end and the distal end;

at least two folding lines approximately perpendicular to the opening direction;

a feeding point disposed near a central portion of the front end and receiving a signal transmitted to the ultra-wideband antenna structure; and a short-circuiting point disposed near a corner of the distal end; and a short-circuited metal unit mounted on the first surface, and having a first end and a second end, wherein the first end is electrically connected to the ground surface, and the second end is electrically connected to the short circuiting point of the radiating element, and a part of the short-circuited metal unit is disposed on an edge of the first surface.

2. An ultra-wideband antenna structure as claimed in claim 1, wherein the front end and the distal end are approximately perpendicular to the opening direction and the opening direction is approximately parallel to the substrate.

3. An ultra-wideband antenna structure as claimed in claim 1, wherein the three-dimensional metal piece comprises two arms partitioned by the radiating portion, and each of the two arms has an identical width.

4. An ultra-wideband antenna structure as claimed in claim 1, wherein the three-dimensional metal piece comprises two arms partitioned by the radiating portion, and each of the two arms is getting wider from the front end to the distal end.

5. An ultra-wideband antenna structure as claimed in claim 1, wherein the three-dimensional metal piece comprises two arms partitioned by the radiating portion, and each of the two arms is getting narrower from the front end to the distal end.

6. An ultra-wideband antenna structure as claimed in claim 1, wherein the substrate is rectangular.

7. An ultra-wideband antenna structure as claimed in claim 1, further comprising a supporting unit mounted between the radiating element and the substrate for supporting thereby the radiating element.

8. An ultra-wideband antenna structure as claimed in claim 7, wherein the supporting unit is made of one of a polystyrene and a plastic.

9. An ultra-wideband antenna structure as claimed in claim 1, wherein the folded metal piece is made by folding a metal piece being processed with one of a stamping and a cutting.

10. An ultra-wideband antenna structure as claimed in claim 1, wherein the ground surface and the short-circuited metal unit are mounted on the substrate by one of a printing and an etching.

11. An ultra-wideband antenna structure as claimed in claim 1, wherein the substrate is made of a dielectric material.

12. An ultra-wideband antenna structure as claimed in claim 1, wherein the at least two folding lines include a first folding line near the front end and a second folding line near the distal end, and the radiating portion has a width being about 20 millimeter, a height being about 6.4 millimeter from the distal end to the second folding line, and a distance being about 11 millimeter between the first and the second folding lines.

* * * * *